US011434094B2

(12) United States Patent
Saito et al.

(10) Patent No.: US 11,434,094 B2
(45) Date of Patent: Sep. 6, 2022

(54) SHEET CONVEYING DEVICE AND IMAGE FORMING APPARATUS

(71) Applicant: TOSHIBA TEC KABUSHIKI KAISHA, Tokyo (JP)

(72) Inventors: Yuichi Saito, Numazu Shizuoka (JP); Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 359 days.

(21) Appl. No.: 16/449,623

(22) Filed: Jun. 24, 2019

(65) Prior Publication Data

US 2020/0039776 A1 Feb. 6, 2020

(30) Foreign Application Priority Data

Aug. 6, 2018 (JP) ..... JP2018-147586

(51) Int. Cl.
*B65H 5/06* (2006.01)
*B65H 9/16* (2006.01)
*G03G 15/00* (2006.01)

(52) U.S. Cl.
CPC ..... *B65H 9/166* (2013.01); *B65H 5/06* (2013.01); *G03G 15/6529* (2013.01)

(58) Field of Classification Search
CPC ..... B65H 9/166; B65H 9/004; B65H 9/006; B65H 9/008; B65H 5/06; B65H 5/062; B65H 2404/1424; B65H 2404/1523; G03G 15/6529
See application file for complete search history.

(56) References Cited

U.S. PATENT DOCUMENTS 4,546,964 A 10/1985 Linthout
5,235,353 A * 8/1993 Hirano ..... B41J 3/37 346/104
7,857,308 B2 * 12/2010 Nakazawa ..... B65H 9/16 271/252
8,036,588 B2 * 10/2011 Ishida ..... G03G 15/6567 399/395

(Continued)

FOREIGN PATENT DOCUMENTS

JP 63171749 A * 7/1988
JP 06016284 A * 1/1994

(Continued)

OTHER PUBLICATIONS

Extended European Search Report for European Patent Application No. 19189532.5 dated Dec. 19, 2019.

(Continued)

*Primary Examiner* — Luis A Gonzalez
(74) *Attorney, Agent, or Firm* — Amin, Turocy & Watson, LLP

(57) ABSTRACT

According to one embodiment, a sheet conveying device includes a conveying path forming unit and an orthogonal movement permitting part. The conveying path forming unit forms a path for conveying a sheet. The orthogonal movement permitting part is provided in the conveying path. The orthogonal movement permitting part conveys the sheet along the conveying direction. The orthogonal movement permitting part allows the sheet to move in a conveying orthogonal direction orthogonal to the conveying direction.

8 Claims, 7 Drawing Sheets

(56) References Cited

U.S. PATENT DOCUMENTS

| | | | | |
|---|---|---|---|---|
| 2005/0098939 | A1* | 5/2005 | Lin | B65H 3/0661 271/109 |
| 2008/0251998 | A1 | 10/2008 | Muneyasu et al. | |
| 2013/0285315 | A1* | 10/2013 | Deno | B65H 9/006 271/226 |
| 2014/0103596 | A1 | 4/2014 | Saito et al. | |
| 2019/0016162 | A1 | 1/2019 | Shibata | |

FOREIGN PATENT DOCUMENTS

| | | | |
|---|---|---|---|
| JP | 2002-104687 | | 4/2002 |
| JP | 2003201043 | A * | 7/2003 |
| JP | 2008-074620 | | 4/2008 |
| JP | 2012-062194 | | 3/2012 |

OTHER PUBLICATIONS

Japanese Office Action for Japanese Patent Application No. 2018-147586 dated Feb. 22, 2022.
Chinese Office Action for Chinese Patent Application No. 201910690143.2 dated Mar. 17, 2022.

* cited by examiner 50a can have a first friction coefficient K1 in the direction of Vs and can have a second friction coefficient K2 in the direction of V1, where K2 < K1

SHEET CONVEYING DEVICE AND IMAGE FORMING APPARATUS

CROSS-REFERENCE TO RELATED APPLICATION

This application is based upon and claims the benefit of priority from Japanese Patent Application No. 2018-147586, filed Aug. 6, 2018, the entire contents of which are incorporated herein by reference.

FIELD

Embodiments described herein relate to a sheet conveying device, an image forming system, and methods related thereto.

BACKGROUND

In a related art, there are image forming systems such as a multi-function peripheral (hereinafter, referred to as "MFP") and a printer. The image forming system includes a sheet conveying device that conveys a sheet. The sheet conveying device includes a conveying path forming unit that forms a path for conveying a sheet. The sheet conveying device includes an aligning mechanism as an inclination correction mechanism in sheet conveyance. The aligning mechanism corrects the inclination of a sheet by bringing a leading end of the sheet conveyed along the conveying path into contact with a nip of rollers (aligning rollers) to be aligned. Depending on the inclination and the stiffness of the sheet, when the leading end of the sheet is aligned, the sheet is bent or the sheet is laterally slipped by the conveying roller part, and thus the leading end of the sheet is aligned with the aligning roller. For this reason, the sheet conveying device feeds a sheet longer than the distance from the conveying roller part to the aligning roller.

However, there is a limitation to the bending amount and the laterally sliding amount of the sheet, and there is a possibility that the inclination of the sheet cannot be sufficiently corrected for the sheet having an inclination of a certain amount or more.

DETAILED DESCRIPTION

Figure 1:
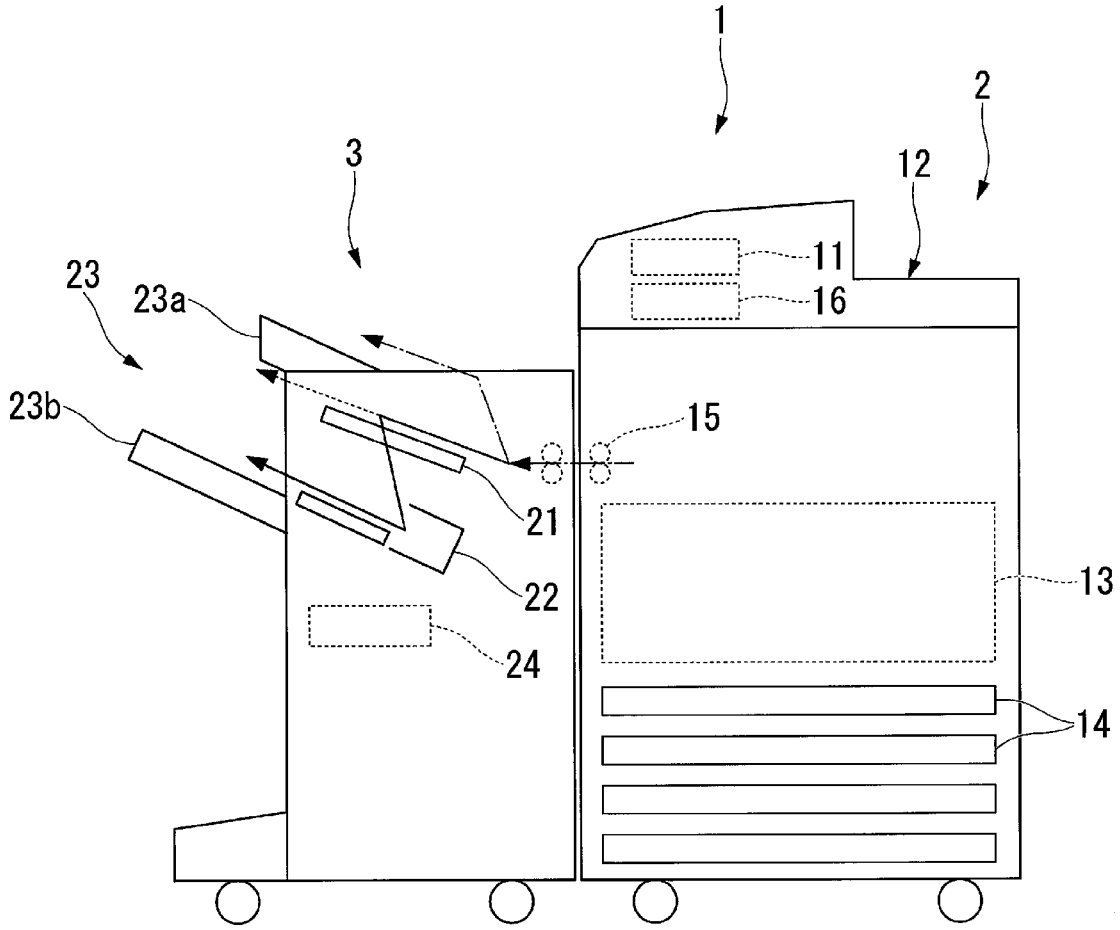
FIG. 1 is a front view illustrating an example of an image forming system according to an embodiment.

Embodiments provide a sheet conveying device and an image forming system capable of sufficiently correcting the inclination of a sheet.

According to one embodiment, the sheet conveying device includes a conveying path forming unit and an orthogonal movement permitting part. The conveying path forming unit forms a path for conveying a sheet. The orthogonal movement permitting part is provided in the conveying path. The orthogonal movement permitting part conveys the sheet along the conveying direction. The orthogonal movement permitting part allows the sheet to move in a conveying orthogonal direction that is orthogonal to the conveying direction.

Hereinafter, a sheet conveying device and an image forming system of the embodiment will be described with reference to drawings. In each drawing, the same reference numeral is given to the same configuration. In each drawing, the dimensions and shapes of the respective members are exaggerated or simplified for easy viewing.

FIG. 1 is a front view illustrating an example of an image forming system 1 according to an embodiment. As illustrated in FIG. 1, the image forming system 1 includes an image forming device 2 and a post-processing device 3. The image forming device 2 forms an image on a sheet-like medium (hereinafter, referred to as "sheet") such as a sheet. The post-processing device 3 performs post-processing on the sheet conveyed from the image forming device 2. The post-processing device 3 is an example of a "sheet processing device".

The image forming device 2 includes a control panel 11, a scanner unit 12, a printer unit 13, a sheet feeding unit 14, a sheet discharge unit 15, and an image formation control unit 16.

The control panel 11 includes various keys for receiving user operations. For example, the control panel 11 receives an input regarding the type of sheet post-processing. The control panel 11 transmits the information regarding the type of post-processing input to the post-processing device 3.

The scanner unit 12 includes a reading unit that reads image information of an object to be copied. The scanner unit 12 transmits the read image information to the printer unit 13.

The printer unit 13 forms an output image (hereinafter, referred to as a "toner image") with a developer such as a toner based on image information transmitted from the scanner unit 12 or an external device. The printer unit 13 transfers the toner image onto the surface of the sheet. The printer unit 13 applies heat and pressure to the toner image transferred to the sheet to fix the toner image on the sheet.

The sheet feeding unit 14 feeds sheets to the printer unit 13 one by one at the timing when the printer unit 13 forms a toner image.

The sheet discharge unit 15 conveys the sheet discharged from the printer unit 13 to the post-processing device 3.

The image formation control unit 16 controls the operation of the entire image forming device 2. That is, the image formation control unit 16 controls the control panel 11, the scanner unit 12, the printer unit 13, the sheet feeding unit 14, and the sheet discharging unit 15. The image formation control unit 16 is formed of a control circuit including a CPU, a ROM, and a RAM.

Next, the post-processing device 3 will be described.

The post-processing device 3 is disposed to be adjacent to the image forming device 2. The post-processing device 3 executes post-processing specified through the control panel 11 on the sheet conveyed from the image forming device 2. For example, post-processing is stapling or sorting. The post-processing device 3 includes a standby unit 21, a processing unit 22, a discharge unit 23, and a post-processing control unit 24. In the embodiment, the sheet is conveyed from the image forming device 2 to the discharge unit 23.

The standby unit 21 temporarily holds (buffers) the sheet conveyed from the image forming device 2. For example, while the post-processing of a preceding sheet is performed by the processing unit 22, the standby unit 21 causes a plurality of subsequent sheets to stand by. The standby unit 21 is disposed above the processing unit 22. When the processing unit 22 becomes empty, the standby unit 21 drops the retained sheet toward the processing unit 22.

The processing unit 22 performs post-processing on the sheet. For example, the processing unit 22 aligns a plurality of sheets. The processing unit 22 staples a plurality of aligned sheets. Accordingly, the plurality of sheets is bound. The processing unit 22 discharges the post-processed sheet to the discharge unit 23.

The discharge unit 23 includes a fixed tray 23*a* and a movable tray 23*b*. The fixed tray 23*a* is provided on the top of the post-processing device 3. The movable tray 23*b* is provided on the side of the post-processing device 3. The sorted sheets are discharged to the fixed tray 23*a* and the movable tray 23*b*.

The post-processing control unit 24 controls the operation of the entire post-processing device 3. That is, the post-processing control unit 24 controls the standby unit 21, the processing unit 22, and the discharge unit 23. The post-processing control unit 24 is formed of a control circuit including a CPU, a ROM, and a RAM.

For example, the post-processing control unit 24 controls switching between a processing mode and a non-processing mode (normal mode). Here, the processing mode means a mode for performing post-processing on a sheet. For example, the processing mode includes a sorting mode and a stapling mode. The non-processing mode means a mode in which the sheet is conveyed as it is without post-processing on the sheet.

The control panel 11 includes a mode selection unit (operation unit) capable of selecting the processing mode and the non-processing mode (not illustrated). For example, the mode selection unit is a button provided on the control panel 11. When a user selects the "processing mode" at the time of selecting a mode and presses the button, the post-processing control unit 24 performs post-processing on the sheet. On the other hand, when the user selects the "non-processing mode" at the time of selecting a mode and presses the button, the post-processing control unit 24 discharges the sheet as it is without performing post-processing on the sheet.

Next, the sheet conveying device will be described.

Figure 2:
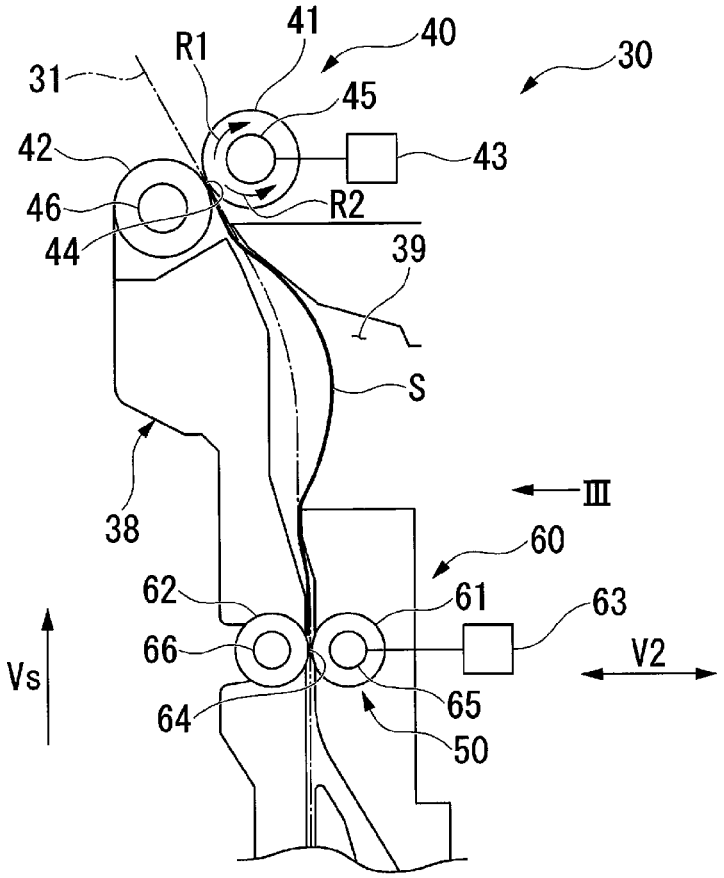
FIG. 2 is a schematic view illustrating a main part of a sheet conveying device.

The image forming system 1 includes a sheet conveying device 30 (see FIG. 2). In the embodiment, the sheet conveying device 30 is provided in the image forming device 2. The sheet conveying device 30 is disposed between the sheet feeding unit 14 and the printer unit 13. The sheet conveying device 30 corrects the inclination of a sheet to be conveyed from the sheet feeding unit 14 to the printer unit 13.

FIG. 2 is a schematic view illustrating a main part of the sheet conveying device 30 of the embodiment. FIG. 2 illustrates how a sheet is aligned while being bent. As illustrated in FIG. 2, a conveying path 31 is provided inside the image forming device 2 (see FIG. 1). The sheet conveying device 30 includes a conveying path forming unit 38, an aligning mechanism 40, and a conveying mechanism 60 (orthogonal movement permitting part 50).

A sheet is conveyed upward from below along the conveying path 31. The sheet is conveyed from the sheet feeding unit 14 (for example, a sheet feeding cassette) to the printer unit 13 (for example, an image forming unit) via the sheet conveying device 30 (see FIG. 1). Hereinafter, in a direction Vs of conveying a sheet (hereinafter, referred to as "sheet conveying direction Vs"), the sheet feeding unit 14 side (the lower side in FIG. 2) is referred to as "upstream side". Further, in the sheet conveying direction Vs, the printer unit 13 side (the upper side in FIG. 2) is referred to as "downstream side".

Hereinafter, a direction V1 (depth direction in FIG. 2) orthogonal to the sheet conveying direction Vs in the sheet surface of the sheet conveyed along the conveying path 31 is referred to as a "first conveying orthogonal direction V1". Hereinafter, a direction V2 (left and right direction in FIG. 2) orthogonal to the sheet conveying direction Vs and the first conveying orthogonal direction V1 is referred to as a "second conveying orthogonal direction V2".

The conveying path forming unit 38 forms the conveying path 31 between the sheet feeding unit 14 (see FIG. 1) and the printer unit 13 (see FIG. 1). The conveying path forming unit 38 forms a bending space 39 of a sheet S at a position close to a pair of aligning rollers 41 and 42. FIG. 2 illustrates a state in which the sheet S is bent by bringing the leading end of the sheet into contact with a nip 44 of the pair of the aligning rollers 41 and 42.

Next, the aligning mechanism 40 will be described.

As illustrated in FIG. 2, the aligning mechanism 40 includes the pair of the aligning rollers 41 and 42, and an aligning motor 43. The aligning mechanism 40 adjusts the position of the leading end of the sheet conveyed by the conveying mechanism 60.

The pair of the aligning rollers 41 and 42 are provided between a pair of conveying rollers 61 and 62, and the printer unit 13 (see FIG. 1) in the sheet conveying direction Vs. For example, in the sheet conveying direction Vs, the pair of the aligning rollers 41 and 42 are provided between the pair of the conveying rollers 61 and 62, and a secondary transfer roller and a backup roller (not illustrated) that constitute the printer unit 13. The pair of the aligning rollers 41 and 42 include the first aligning roller 41 and the second aligning roller 42 facing each other. The first aligning roller 41 and the second aligning roller 42 abut on each other to form the nip 44. The aligning mechanism 40 aligns the position of the leading end of the sheet by bringing the sheet conveyed along the conveying path 31 into contact with the nip 44. Here, the position of the leading end of the sheet means a position of the downstream end of the sheet in the sheet conveying direction Vs.

The first aligning roller 41 is a driving roller driven by the aligning motor 43. The first aligning roller 41 forwardly rotates when the sheet passes through the nip 44. The first aligning roller 41 rotates (forwardly rotates) clockwise (in the direction of arrow R1 in FIG. 2) when the sheet passes through the nip 44. The first aligning roller 41 reversely rotates when the sheet abuts against the nip 44. The first aligning roller 41 rotates (reversely rotates) counterclockwise (in the direction of arrow R2 in FIG. 2) when the sheet abuts against the nip 44.

The second aligning roller 42 is a driven roller that rotates (follows rotation) according to the rotation of the first aligning roller 41. The pair of the aligning rollers 41 and 42 conveys the sheet supplied from the pair of the conveying rollers 61 and 62 toward the downstream side of the conveying path 31.

Figure 3:
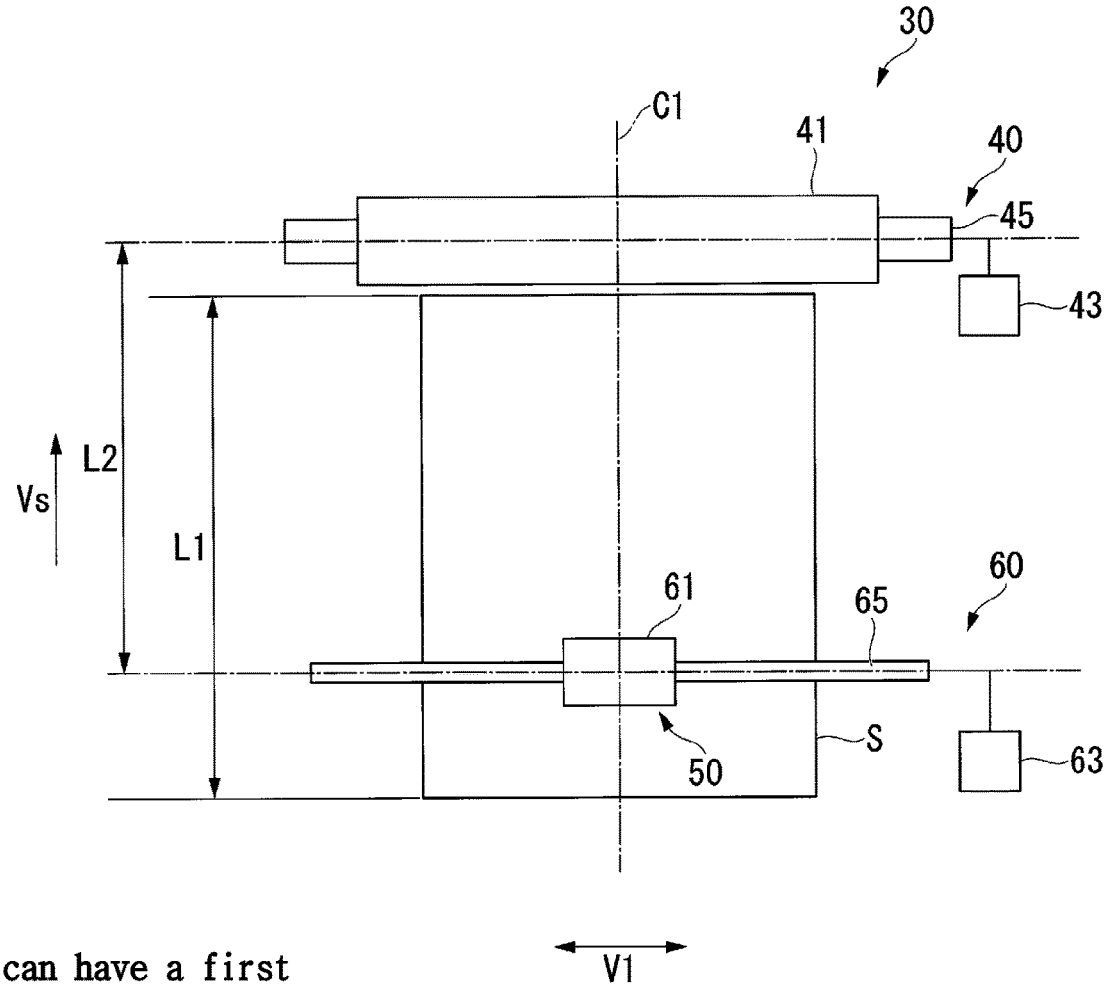
FIG. 3 is a view of the main part of the sheet conveying device as viewed from one side in a second conveying orthogonal direction (as viewed in the direction of arrow III in FIG. 2)

FIG. 3 is a view (as viewed in the direction of arrow III in FIG. 2) of the main part of the sheet conveying device 30 according to the embodiment as viewed from one side of the second conveying orthogonal direction V2. In FIG. 3, the illustration of the conveying path forming unit 38 and the like is omitted.

As illustrated in FIG. 3, the first aligning roller 41 is fixed to a first aligning shaft 45 (rotational shaft). The first aligning roller 41 extends along the first aligning shaft 45. The first aligning roller 41 has a shape of linear symmetry with a first conveying orthogonal direction center line C1 as an axis of symmetry. The first aligning shaft 45 extends linearly in the first conveying orthogonal direction V1. The first aligning roller 41 is longer than the sheet in the first conveying orthogonal direction V1. The first aligning shaft 45 is longer than the first aligning roller 41 in the first conveying orthogonal direction V1. Both ends of the first aligning shaft 45 are rotatably supported on the main body of the image forming device by bearings (not illustrated). The first aligning shaft 45 is connected to the aligning motor 43. The aligning motor 43 rotationally drives the first aligning shaft 45.

As illustrated in FIG. 2, the second aligning roller 42 is fixed to a second aligning shaft 46 (rotational shaft) extending parallel with the first aligning shaft 45. One second aligning roller 42 is disposed to face the first aligning roller 41. Both ends of the second aligning shaft 46 are rotatably supported by the main body of the image forming device by bearings (not illustrated).

Next, the conveying mechanism 60 will be described.

The conveying mechanism 60 is provided at the upstream position of the aligning mechanism 40 in the sheet conveying direction Vs. The conveying mechanism 60 includes the pair of the conveying rollers 61 and 62, and a sheet conveying motor 63.

The pair of the conveying rollers 61 and 62 includes the first conveying roller 61 and the second conveying roller 62 facing each other. The first conveying roller 61 is driven by the sheet conveying motor 63. The second conveying roller 62 rotates (follows rotation) according to the rotation of the first conveying roller 61. The pair of the conveying rollers 61 and 62 conveys the sheet supplied from a pickup roller 33 toward the downstream side of the conveying path 31. The respective conveying rollers 61 and 62 convey the sheet by being in contact with the sheet when the sheet passes through the nip 44 of the pair of the aligning rollers 41 and 42. When the sheet abuts against the nip 44, the respective conveying rollers 61 and 62 convey the sheet by being in contact with the sheet.

As illustrated in FIG. 3, the first conveying roller 61 is fixed to a first conveying shaft 65 (rotational shaft). The number of the first conveying roller 61 to be disposed on the first conveying shaft 65 (shaft part) is one. The first conveying roller 61 is disposed at a position overlapping the first conveying orthogonal direction center line C1. The first conveying roller 61 is disposed at a central position of the first conveying orthogonal direction V1. The first conveying shaft 65 extends linearly in the first conveying orthogonal direction V1. The first conveying shaft 65 is longer than the sheet S in the first conveying orthogonal direction V1. Both ends of the first conveying shaft 65 are rotatably supported by the main part of the image forming device by bearings (not illustrated). The first conveying shaft 65 is connected to the sheet conveying motor 63. The sheet conveying motor 63 rotationally drives the first conveying shaft 65.

As illustrated in FIG. 2, the second conveying roller 62 is fixed to a second conveying shaft 66 (rotational shaft) extending parallel with the first conveying shaft 65. The number of the second conveying roller 62 to be disposed to face the first conveying rollers 61 is two. Both ends of the second conveying shaft 66 are rotatably supported by the main body of the image forming device by bearings (not illustrated).

In FIG. 3, a reference numeral L1 denotes a sheet length in the sheet conveying direction Vs, and a reference numeral L2 denotes a sheet conveying path length. Here, the sheet conveying path length L2 means the distance between the central axis of the first conveying roller 61 and the central axis of the first aligning roller 41 in the sheet conveying direction Vs. The sheet conveying path length L2 is shorter than the sheet length L1 (L2<L1).

Next, the orthogonal movement permitting part 50 will be described.

As illustrated in FIG. 2, at least apart of the conveying mechanism 60 constitutes the orthogonal movement permitting part 50 provided in the conveying path 31. In the embodiment, the first conveying roller 61 and the first conveying shaft 65 function as the orthogonal movement permitting part 50. The orthogonal movement permitting part 50 conveys the sheet. The orthogonal movement permitting part 50 allows the sheet to move in the first conveying orthogonal direction V1 (see FIG. 3). The orthogonal movement permitting part 50 allows the sheet to move in a direction obliquely intersecting the first conveying orthogonal direction center line C1 (see FIG. 3).

Figure 4:
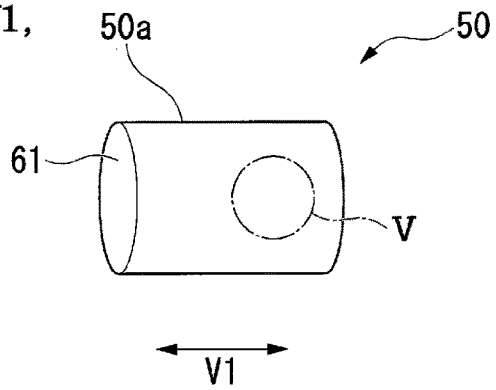
FIG. 4 is a perspective view illustrating an orthogonal movement permitting part.

As illustrated in FIG. 4, the orthogonal movement permitting part 50 includes a contact surface 50*a* that is in contact with the sheet. The contact surface 50*a* is an outer circumferential surface of the first conveying roller 61. In FIG. 4, the illustration of the first conveying shaft 65 and the like is omitted.

The contact surface 50*a* has a first friction coefficient K1 in the sheet conveying direction Vs (see FIG. 3). The contact surface 50*a* has a second friction coefficient K2 smaller than the first friction coefficient K1 in the first conveying orthogonal direction V1 (K2<K1). For example, the first conveying roller 61 is a rubber roller having an anisotropic friction generation direction.

Figure 5:
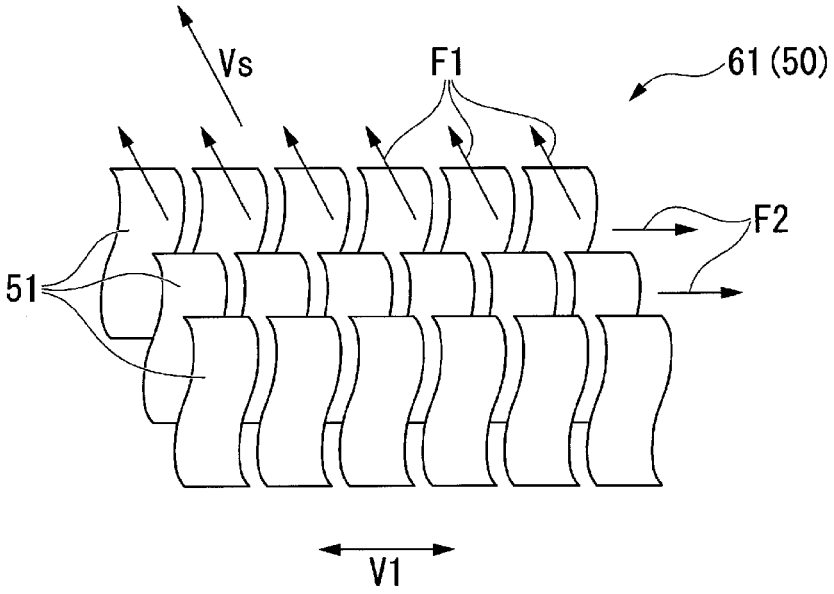
FIG. 5 is an enlarged perspective view illustrating a main part of the orthogonal movement permitting part (enlarged view of the dashed-dotted line part V of FIG. 4)

As illustrated in FIG. 5, the first conveying roller 61 has a discontinuous pattern of rubber plate shape on the surface thereof. A plurality of plate members 51 (hereinafter, also referred to as "rubber plate 51") formed of an elastic member such as rubber is provided on the outer circumferential surface of the first conveying roller 61. The plurality of rubber plates 51 are arranged at intervals in the circumferential direction of the first conveying roller 61. The plurality of rubber plates 51 are arranged at intervals in the axial direction of the first conveying roller 61 (first conveying orthogonal direction V1).

Next, the behavior of the sheet at the time of aligning the sheet will be described. The following description is a description of a comparative example which does not have the orthogonal movement permitting part 50 of the embodiment.

Figure 6:
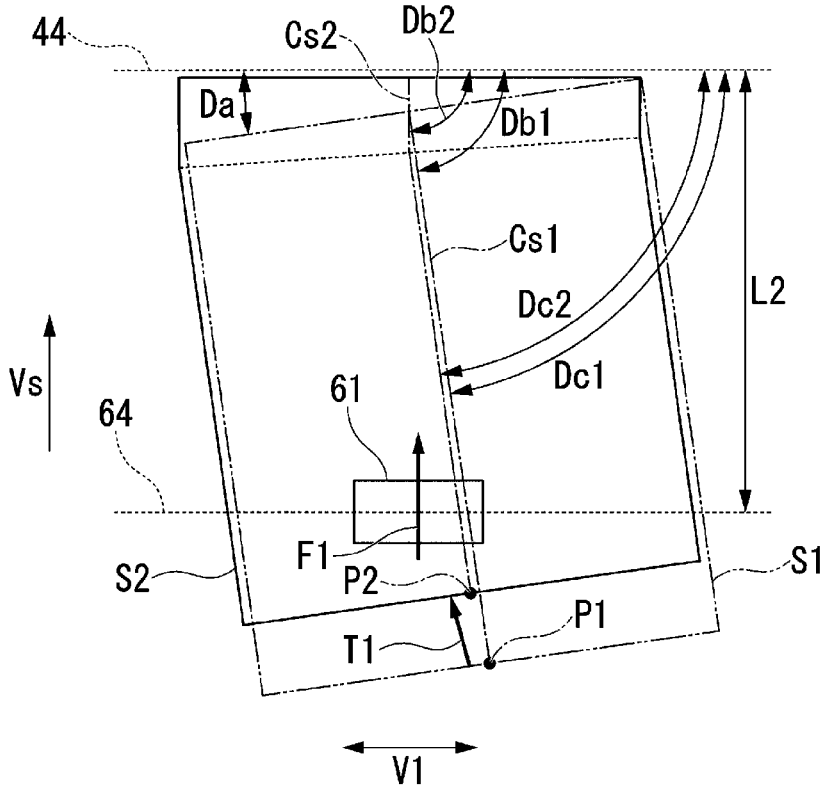
FIG. 6 is an explanatory view when a sheet is aligned while being bent in a comparative example.
Figure 7:
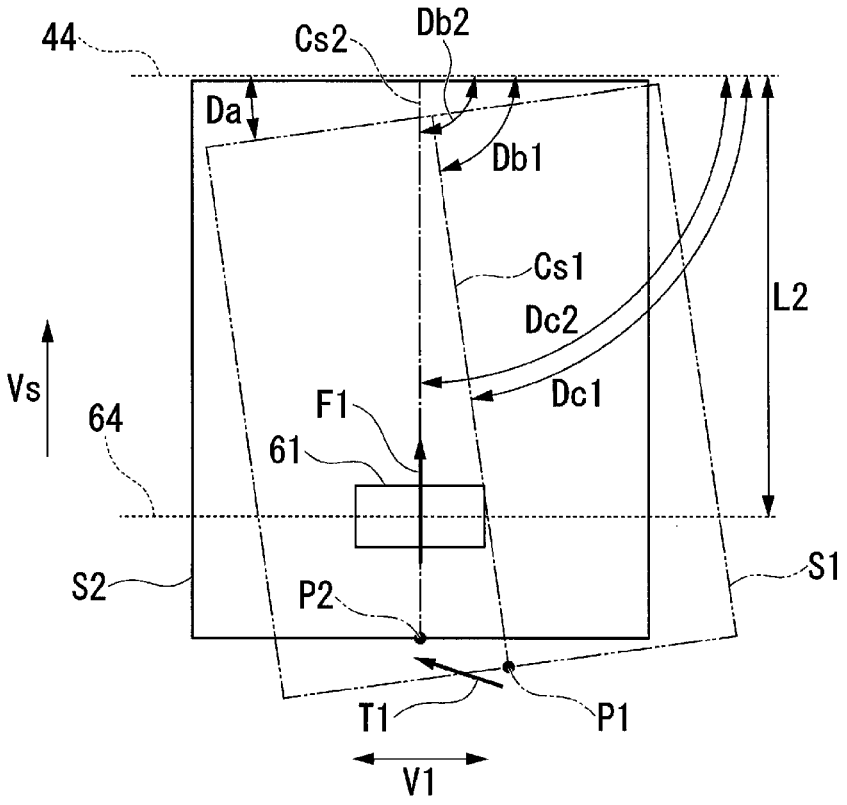
FIG. 7 is an explanatory view when a sheet is aligned while laterally sliding in the comparative example.

FIG. 6 is an explanatory view when the sheet is aligned while being bent in the comparative example. FIG. 7 is an explanatory view when the sheet is aligned while laterally sliding in the comparative example. Here, the laterally sliding means that the sheet slides in the first conveying orthogonal direction V1.

In the aligning processing, the sheet is conveyed such that an initial angle Da of the sheet becomes zero, and the leading end of the sheet is aligned with the nip 44 of the pair of the aligning rollers. Here, the initial angle Da means the angle between the nip 44 of the pair of the aligning rollers (the central axis of the aligning rollers) and the leading end of the sheet before the aligning processing. For example, a sheet with low rigidity (thin paper) is likely to be aligned while being bent (see FIG. 6). For example, a sheet with high rigidity (thick paper) is likely to be aligned while laterally sliding (see FIG. 7).

In the comparative example, both the bending and the lateral sliding of the sheet reach a limit with a constant amount. Therefore, there is a high possibility that the initial angle Da will not be zero when the limit amount of bending or lateral sliding is exceeded, depending on the size of the initial angle Da. In the comparative example, when the limit amount of bending or lateral sliding is exceeded, the limit amount of the alignment correction amount is obtained.

In the FIGS. 6 and 7, a reference numeral F1 indicates a conveying force of a sheet by a conveying roller, a reference numeral 51 indicates the sheet before aligning (hereafter, also referred to as "pre-processing sheet"), and a reference numeral S2 indicates the sheet at the time of aligning (hereafter, also referred to as "processing sheet". A reference numeral P1 indicates the center position of the rear end of the pre-processing sheet S1, a reference numeral P2 indicates the center position of the rear end of the processing sheet S2, and an arrow T1 indicates the moving direction of the center position of the rear end of the sheet from the pre-processing sheet S1 to the processing sheet S2. A reference numeral Db1 indicates an angle between the nip 44 of the pair of aligning rollers and a width direction center line Cs1 of the pre-processing sheet S1 (near the leading end of the sheet), a reference numeral Db2 indicates an angle between the nip 44 of the pair of aligning rollers and a width direction center line Cs2 of the processing sheet S2 (near the leading end of the sheet), a reference numeral Dc1 indicates an angle between the nip 44 of the pair of aligning rollers and the width direction center line Cs1 of the pre-processing sheet S1 (center position of the sheet), and a reference numeral Dc2 indicates an angle between the nip 44 of the pair of aligning rollers and the width direction center line Cs2 of the processing sheet S2 (center position of the sheet).

As illustrated in FIG. 6, when the initial angle Da is too large, even when the sheet is continuously fed by the conveying roller, the leading end of the sheet may not be in the nip 44 of the pair of the aligning rollers, and the sheet may not be aligned. When the angle Db2 between the nip 44 of the pair of the aligning rollers and the width direction center line Cs2 of the processing sheet S2 (near the leading end of the sheet) is less than 90 degrees, the sheet is not aligned.

Next, the operation of the orthogonal movement permitting part 50 of the embodiment will be described.

As illustrated in FIG. 5, in the sheet conveying direction Vs, the rubber plates 51 generate a conveying force (arrow F1 in the drawing) by being in contact with the sheet. In the span between two adjacent rubber plates 51, the rubber plates 51 are separated from the sheet to release the restraint of the sheet. By releasing the restraint of the sheet, if a force in the first conveying orthogonal direction V1 (hereinafter, also referred to as a "lateral force") is applied to the sheet, the sheet can be moved in response to the lateral force (arrow F2 in the drawing). As a result, since the sheet can be moved (hereafter, also referred to as "lateral movement") in the first conveying orthogonal direction V1 in accordance with the initial angle at the time of aligning the sheet, the limit on the amount of lateral sliding of the sheet is theoretically eliminated. Therefore, according to the embodiment, the aligning correction amount can be made larger than that of the comparative example.

According to the embodiment, the sheet conveying device includes the conveying path forming unit 38 and the orthogonal movement permitting part 50. The conveying path forming unit 38 forms the conveying path 31 of the sheet. The orthogonal movement permitting part 50 is provided in the conveying path 31. The orthogonal movement permitting part 50 conveys the sheet along the sheet conveying direction Vs. The orthogonal movement permitting part 50 allows lateral movement of the sheet. By the above configuration, the following effects can be obtained. While the sheet is conveyed by the orthogonal movement permitting part 50, the sheet can be actively slid laterally. That is, if a lateral force is applied to the sheet in the process of conveying the sheet, the sheet can be moved laterally in accordance with the lateral force. Therefore, the inclination of the sheet can be sufficiently corrected. In addition, the generation of noise can be controlled since it is possible to reduce excessive bending of the sheet. In addition, since it is possible to inhibit the sheet from being excessively bent, it is possible to prevent the sheet from being folded in a Z-shape (Z-folded paper) or to prevent the sheet from having a crease.

The orthogonal movement permitting part 50 includes the contact surface 50*a* that is in contact with the sheet. The contact surface 50*a* has the first friction coefficient K1 in the sheet conveying direction Vs. The contact surface 50*a* has the second friction coefficient K2 smaller than the first friction coefficient K1 in the first conveying orthogonal direction V1. By the above configuration, the following effects can be obtained. While the sheet is conveyed by the action of the first friction coefficient K1, the sheet can be slid laterally by the action of the second friction coefficient 2. Therefore, the inclination of the sheet can be sufficiently corrected.

The orthogonal movement permitting part 50 achieves the following effect by being disposed at the center position of the first conveying orthogonal direction V1. If the orthogonal movement permitting part 50 is disposed only at the outer end position of the first conveying orthogonal direction V1, when the inclination of the sheet is too large, the orthogonal movement permitting part 50 and the sheet are likely to be separated from each other in a plan view. According to the embodiment, even when the inclination of the sheet is too large, the orthogonal movement permitting part 50 and the sheet overlap each other in a plan view by arranging the orthogonal movement permitting part 50 at the center position of the first conveying orthogonal direction V1. Therefore, the inclination of the sheet can be sufficiently corrected.

By arranging only one orthogonal movement permitting part 50 at the center position of the first conveying orthogonal direction V1, the following effect can be obtained. As compared with the case where a plurality of orthogonal movement permitting parts 50 are arranged along the first conveying orthogonal direction V1, the sheet can be easily slid laterally, and therefore, the inclination of the sheet can be sufficiently corrected.

The sheet conveying device 30 achieves the following effect by further including the aligning mechanism 40 that adjusts the position of the leading end of the sheet conveyed by the orthogonal movement permitting part 50. At the time of aligning the sheet, the inclination of the sheet can be sufficiently corrected.

Hereinafter, modification examples will be described.

The orthogonal movement permitting part 50 is not limited to the provision of a rubber roller having an anisotropic friction generation direction.

Figure 8:
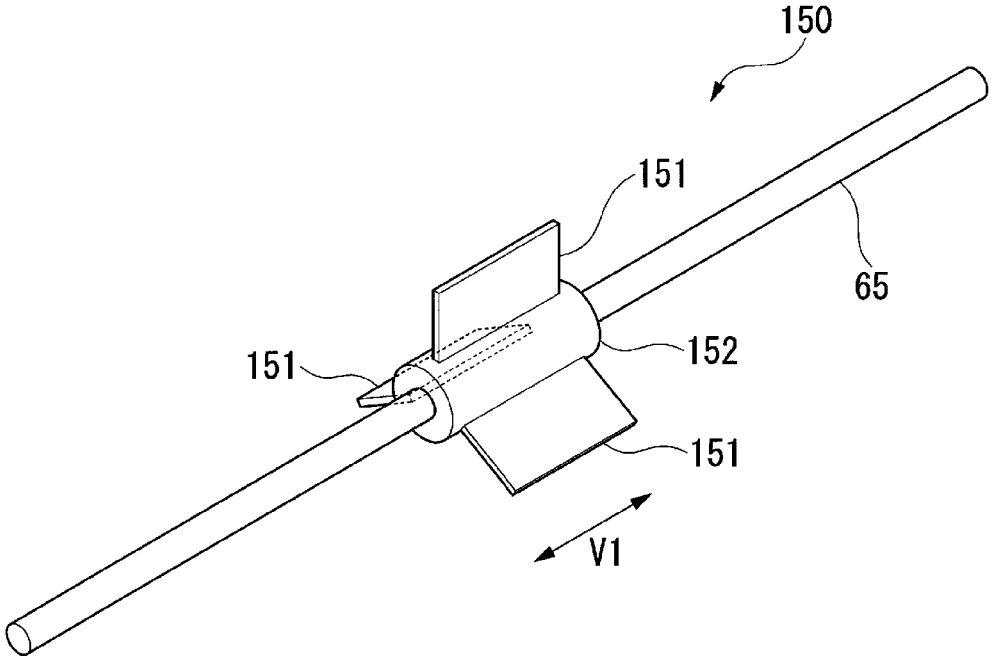
FIG. 8 is a perspective view illustrating an orthogonal movement permitting part of a first modification example.

FIG. 8 is a perspective view illustrating an orthogonal movement permitting part 150 of a first modification example of the embodiment.

As illustrated in FIG. 8, the orthogonal movement permitting part 150 may include a plurality of plate members 151 arranged at intervals in the circumferential direction of the first conveying shaft 65. For example, the plate member 151 is formed of an elastic member such as rubber. That is, the orthogonal movement permitting part 150 may include a paddle provided with a plurality of rubber plates. In the example of FIG. 8, three plate members 151 are illustrated. In FIG. 8, reference numeral 152 indicates a connecting part that connects the plurality of plate members 151 and the first conveying shaft 65. The plurality of plate members 151 rotate with the rotation of the first conveying shaft 65.

According to the present modification example, the inclination of the sheet can be sufficiently corrected with a simple configuration provided with the paddle.

Figure 9:
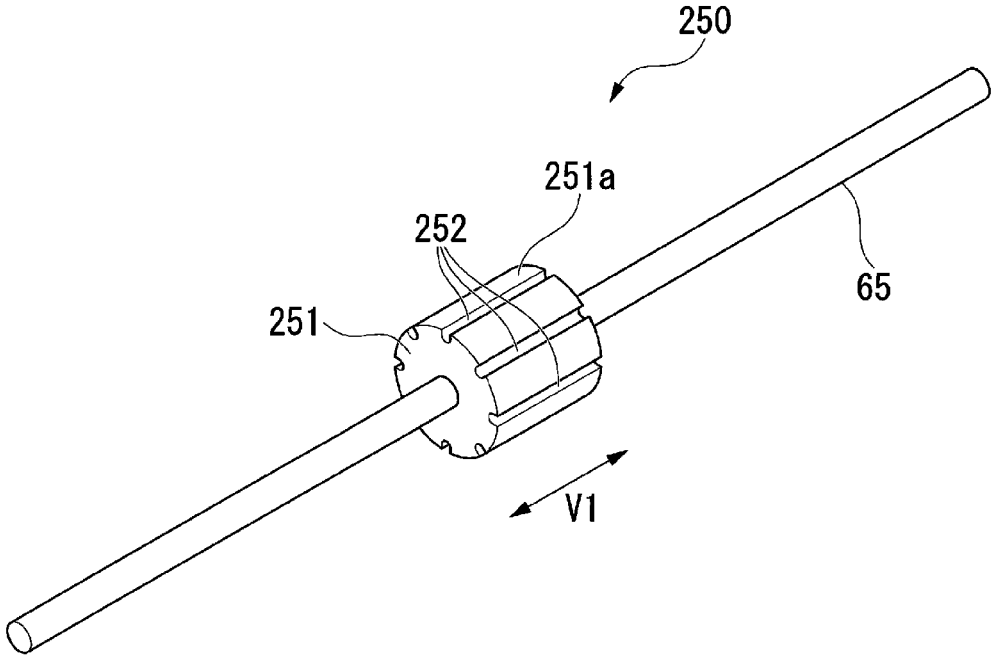
FIG. 9 is a perspective view illustrating an orthogonal movement permitting part of a second modification example.

FIG. 9 is a perspective view illustrating an orthogonal movement permitting part 250 of a second modification example of the embodiment.

As illustrated in FIG. 9, the orthogonal movement permitting part 250 may include a rotating body 251 disposed on the first conveying shaft 65 and having a plurality of groove parts 252. The groove parts 252 are formed on a surface 251*a* of the rotating body 251. The groove parts 252 extend in the first conveying orthogonal direction V1. A plurality of groove parts 252 are arranged at intervals in the circumferential direction of the rotating body 251.

The depth of the groove part 252 is set to have such a depth (the depth at which the groove part 252 remains) that a gap is generated between the groove part 252 and the surface 251*a* of the rotating body 251 even if the surface 251*a* of the rotating body 251 is crushed at the time of conveying the sheet. For example, the rotating body is formed of an elastic member such as rubber. That is, the orthogonal movement permitting part 250 may include a rubber roller having the plurality of groove parts 252 in the circumferential direction thereof. In the example of FIG. 9, six groove parts 252 are illustrated. The rotating body 251 rotates with the rotation of the first conveying shaft 65.

According to the present modification example, the inclination of the sheet can be sufficiently corrected with a simple configuration including the rotating body 251 having the plurality of groove parts 252 in the circumferential direction thereof.

The orthogonal movement permitting part 50 is not limited to including the first conveying roller 61 fixed to the first conveying shaft 65.

Figure 10:
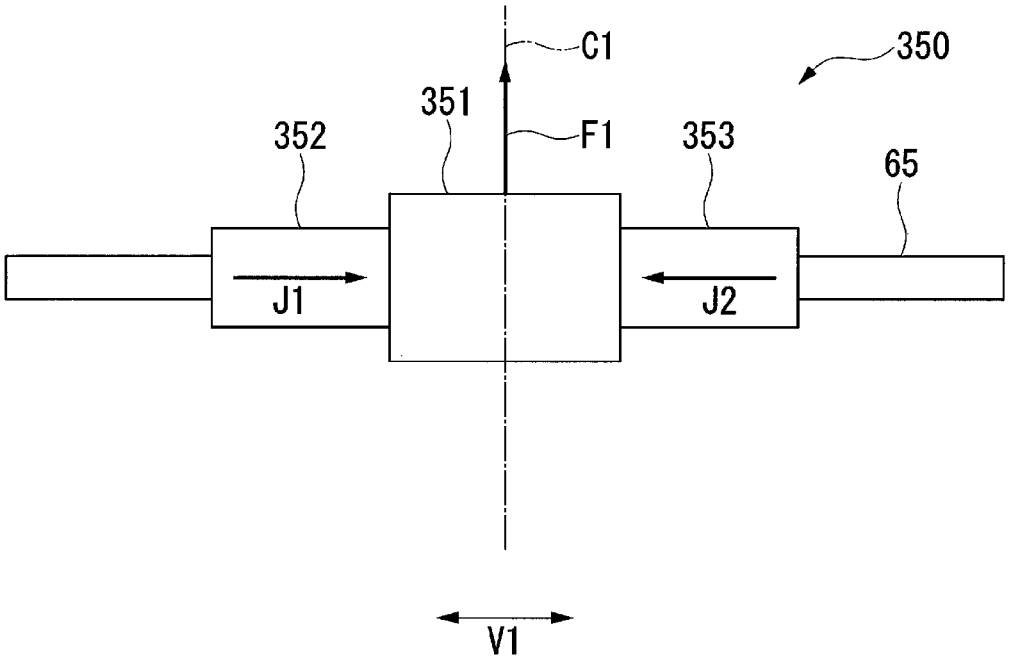
FIG. 10 is a schematic view illustrating an orthogonal movement permitting part of a third modification example.
Figure 11:
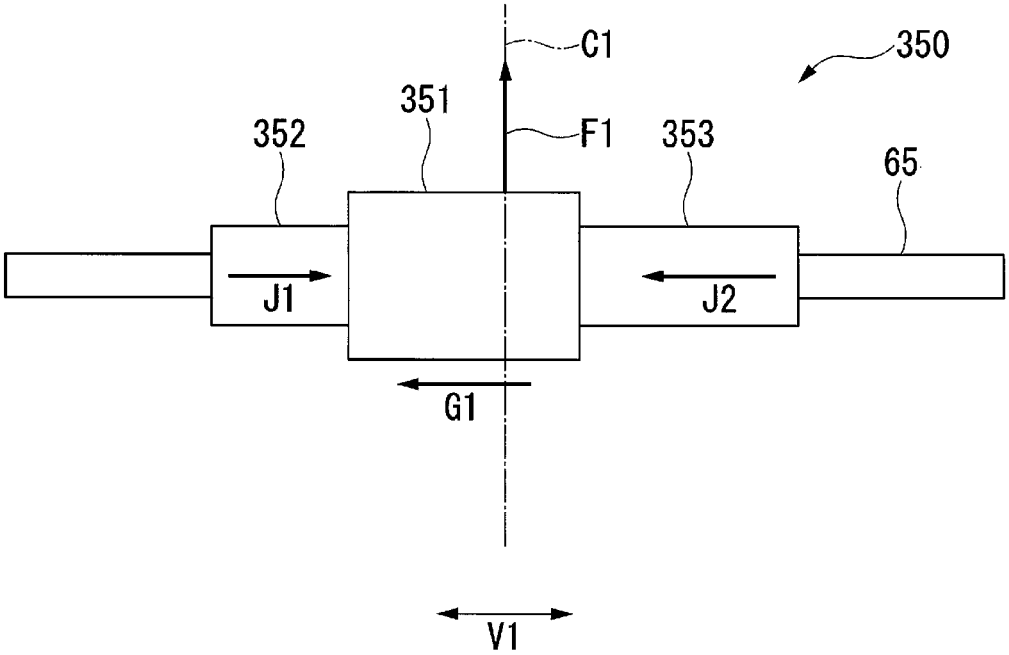
FIG. 11 is an explanatory view describing the operation of the orthogonal movement permitting part of the third modification.

FIG. 10 is a schematic view illustrating an orthogonal movement permitting part 350 of a third modification example of the embodiment. FIG. 11 is an operation explanatory view of the orthogonal movement permitting part 350 of the third modification example of the embodiment.

As illustrated in FIG. 11, the orthogonal movement permitting part 350 may include a rotating body 351 movable along the first conveying shaft 65. For example, the rotating body 351 is a rubber roller. As illustrated in FIG. 10, the orthogonal movement permitting part 350 may include position adjusting parts 352 and 353 for adjusting the position of the rotating body 351 to a reference position in the first conveying orthogonal direction V1. In the example of FIG. 10, the reference position is set at the center position of the first conveying orthogonal direction V1. When normally conveying sheets, the center position of the rotating body 351 overlaps the first conveying orthogonal direction center line C1.

The position adjusting parts 352 and 353 include a first biasing member 352 and a second biasing member 353.

The first biasing member 352 is provided at a first end of the rotating body 351 in the first conveying orthogonal direction V1. The first biasing member 352 biases the rotating body 351 toward the reference position. An arrow J1 in the drawing indicates the biasing direction of the first biasing member 352.

The second biasing member 353 is provided at a second end of the rotating body 351 in the first conveying orthogonal direction V1. The second end of the rotating body 351 is an end opposite to the first end of the rotating body 351 in the first conveying orthogonal direction V1. The second biasing member 353 biases the rotating body 351 toward the reference position. An arrow J2 in the drawing indicates the biasing direction of the second biasing member 353.

Each of the first biasing member 352 and the second biasing member 353 constantly biases the rotating body 351 toward the reference position. The biasing directions J1 and J2 of the first biasing member 352 and the second biasing member 353 are opposite to each other. For example, each of the first biasing member 352 and the second biasing member 353 is a pressure spring. The first biasing member 352 and the second biasing member 353 have substantially the same spring constant (biasing force).

Next, the operation of the orthogonal movement permitting part 350 of the third modification example will be described.

As illustrated in FIG. 10, when normally conveying sheets, the rotating body 351 is held at the central position of the first conveying orthogonal direction V1 by the action of the first biasing member 352 and the second biasing member 353.

As illustrated in FIG. 11, at the time of aligning a sheet, when a sheet having a certain inclination is brought into contact with a nip of the pair of aligning rollers to make the leading end of the sheet to be aligned, a lateral force is generated. At the time of aligning the sheet, the rotating body can be moved laterally in accordance with the lateral force generated on the sheet. The example of FIG. 11 illustrates a state where the rotating body 351 receives a force generated in the left direction of the drawing (the direction of the arrow G1 in the drawing) at the time of aligning the sheet. By the pressure spring (first biasing member 352) on the left side of the drawing being contracted, the rotating body 351 becomes movable in the left direction of the drawing.

According to the present modification example, the orthogonal movement permitting part 350 achieves the following effect by including the rotating body 351 movable along the first conveying shaft 65. The rotating body 351 can be moved laterally according to the lateral force generated on the sheet. That is, when a lateral force is applied to the sheet in the process of conveying the sheet, the sheet can be moved laterally together with the rotating body 351 according to the lateral force. Therefore, the inclination of the sheet can be sufficiently corrected.

In addition, the orthogonal movement permitting part 350 achieves the following effect by including the position adjusting parts 352 and 353 for adjusting the position of the rotating body 351 to the reference position in the first conveying orthogonal direction V1. It is possible to hold the position of the rotating body 351 at the reference position by the position adjusting parts 352 and 353. Therefore, in the process of conveying a plurality of sheets, the inclination of each sheet can be sufficiently corrected.

The position adjusting parts 352 and 353 include the first biasing member 352 and the second biasing member 353. The first biasing member 352 is provided at a first end of the rotating body 351 in the first conveying orthogonal direction V1. The first biasing member 352 biases the rotating body 351 toward the reference position. The second biasing member 353 is provided at a second end of the rotating body 351 in the first conveying orthogonal direction V1. The second biasing member 353 biases the rotating body 351 toward the reference position. By the above configuration, the following effects can be obtained. As compared with the case where the position adjusting part includes only the biasing member provided at the first end of the rotating body, the position of the rotating body 351 can be easily held at the reference position. That is, even if the sheet is inclined to the first conveying orthogonal direction center line C1 in any of the left and right directions in the drawing, the laterally moved rotating body 351 can be returned to the original reference position after the aligning. Therefore, regardless of the inclination direction of the sheet, the inclination of the sheet can be sufficiently corrected.

The first biasing member 352 and the second biasing member 353 have substantially the same spring constant, and therefore, achieve the following effect. Compared to the case where the first biasing member 352 and the second biasing member 353 have spring constants different from each other, the position of the rotating body 351 can be easily held at the reference position. Therefore, regardless of the inclination direction of the sheet, the inclination of the sheet can be corrected more effectively.

The position adjusting part is not limited to including the biasing members.

Figure 12:
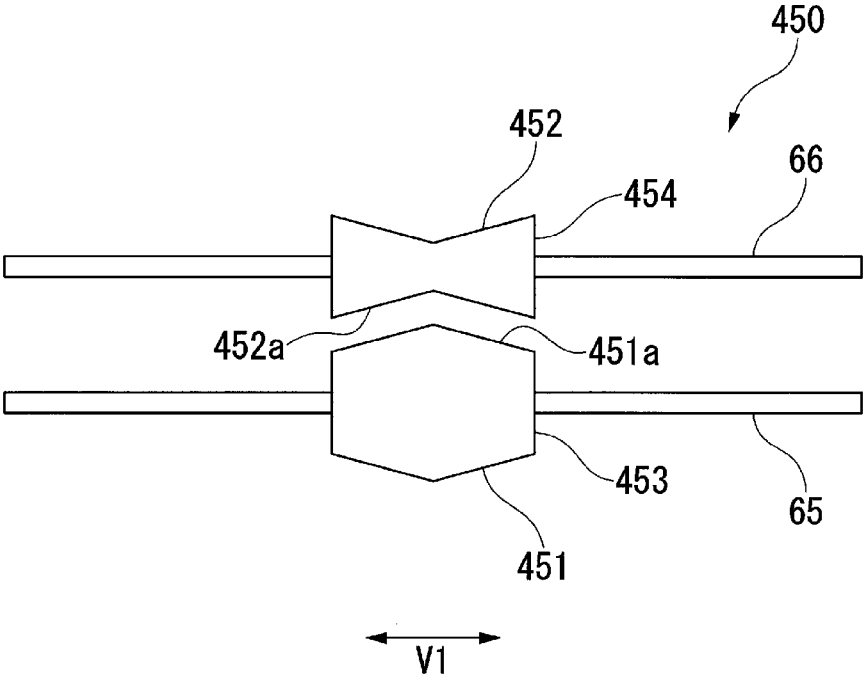
FIG. 12 is a schematic view illustrating an orthogonal movement permitting part of a fourth modification example.

FIG. 12 is a schematic view illustrating an orthogonal movement permitting part 450 of a fourth modification example of the embodiment.

As illustrated in FIG. 12, the position adjusting parts 451 and 452 may include a first adjusting part 451 and a second adjusting part 452. The first adjusting part 451 includes a first outer circumferential surface 451*a* inclined in a V-shape. The second adjusting part 452 has a second outer circumferential surface 452*a* inclined along the first outer circumferential surface 451*a*.

The first adjusting part 451 is provided in a first rotating body 453. The first rotating body 453 is movable along the first conveying shaft 65. For example, the first rotating body 453 is splined to the first conveying shaft 65. For example, the first rotating body 453 provided with the first adjusting part 451 is a crown roller. For example, the first rotating body 453 is a driving roller. In the first outer circumferential surface 451*a* (the outer circumferential surface of the first adjusting part 451), the radially outer end of the first outer circumferential surface 451*a* is located at the axial center of the first rotating body 453, and the radially inner end of the first outer circumferential surface 451*a* is inclined in a V shape to be located at the axially outer end of the first rotating body 453.

The second adjusting part 452 is provided in a second rotating body 454. The second rotating body 454 is movable along the second conveying shaft 66. For example, the second rotating body 454 is splined to the second conveying shaft 66. For example, the second rotating body 454 provided with the second adjusting part 452 is a V roller. For example, the second rotating body 454 is a driven roller. In the second outer circumferential surface 452*a* (the outer circumferential surface of the second adjusting part 452), the radially outer end of the second outer circumferential surface 452*a* is located at the axially outer end of the second rotating body 454, and the radially inner end of the second outer circumferential surface 452*a* is inclined in a V shape to be located at the axial center of the second rotating body 454.

According to the present modification example, the inclination of the sheet can be sufficiently corrected regardless of the inclination direction of the sheet with a simple configuration including the crown roller.

Next, another modification example of the embodiment will be described.

The sheet conveying device 30 is not limited to being disposed between the sheet feeding unit 14 and the printer unit 13. For example, the sheet conveying device 30 may be disposed in the vicinity of the portion where the sheet is reversed. The sheet conveying device 30 may be provided in any of the conveying paths in the image forming system (image forming device, and post-processing device).

The first aligning roller 41 is not limited to reverse rotation when the sheet abuts against the nip 44. For example, the first aligning roller 41 may stop when the sheet abuts against the nip 44. For example, the first aligning roller 41 may reversely rotate after the sheet passes through the nip 44. For example, the sheet conveying device 30 may include a control unit that controls the rotation of the first aligning roller 41.

The aligning mechanism 40 is not limited to including the pair of the aligning rollers 41 and 42. For example, the aligning mechanism 40 may include an aligning roller and a pad (roller contact member). For example, the aligning mechanism 40 may include at least one rotating body.

The conveying mechanism 60 is not limited to including the pair of the conveying rollers 61 and 62. For example, the conveying mechanism 60 may include a conveying roller and a pad (roller contact member). For example, the conveying mechanism 60 may include at least one rotating body.

The number of conveying rollers is not limited to one. For example, two or more conveying rollers may be arranged. The number and position of the conveying rollers may be changed in accordance with the required specifications.

The first conveying roller 61 and the first conveying shaft 65 are not limited to constituting the orthogonal movement permitting part 50. The second conveying roller 62 and the second conveying shaft 66 may also constitute the orthogonal movement permitting part 50. That is, the first conveying roller 61, the first conveying shaft 65, the second conveying roller 62, and the second conveying shaft 66 may function as the orthogonal movement permitting part 50.

The position adjusting part is not limited to including two biasing members. For example, the position adjusting part may include only one biasing member. For example, the biasing member may be provided only at the first end of the rotating body in the first conveying orthogonal direction V1. According to the present modification example, when the inclination direction of the sheet is determined, the inclination of the sheet can be sufficiently corrected.

According to the sheet conveying device of at least one embodiment described above, the inclination of the sheet can be sufficiently corrected.

The functions of the image forming system in the above-described embodiment may be realized by a computer. In that case, a program for realizing the functions may be recorded in a computer-readable recording medium, and the computer system may read and execute the program recorded in the recording medium to realize the functions. The "computer system" referred to here includes an OS and hardware such as peripheral devices. In addition, "the computer-readable recording medium" is a portable medium such as a flexible disk, a magneto-optical disk, a ROM, a CD-ROM or the like, or a storage apparatus such as a hard disk built in the computer system. Further, "computer-readable recording medium" may include a medium that dynamically holds a program for a short period of time, such as a communication line when a program is transmitted via a network such as the Internet or a communication line such as a telephone line, and a medium that holds a program for a certain period of time, such as a volatile memory inside the computer system serving as a server or client in that case. In addition, the above program may be for realizing a part of the above-described functions and further, may be realized by combining the above-described function with a program already recorded in the computer system.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:

a conveying path forming unit configured to form a conveying path of a sheet; and an orthogonal movement permitting device provided in the conveying path and configured to convey the sheet along a conveying direction and allowing the sheet to move in a conveying orthogonal direction orthogonal to the conveying direction;

wherein the orthogonal movement permitting device includes a shaft extending in the conveying orthogonal direction, and wherein the shaft includes only one rubber roller or only one paddle arranged at a center position of the shaft in the conveying orthogonal direction, the shaft includes the one rubber roller, the one rubber roller has an anisotropic friction generation direction and a contact surface that abuts the sheet, and the contact surface has a first friction coefficient in the conveying direction and a second friction coefficient in the conveying orthogonal direction, wherein the second friction coefficient is smaller than the first friction coefficient.

2. The device according to claim 1, further comprising:

an aligning mechanism configured to adjust a position of a leading end of the sheet conveyed by the orthogonal movement permitting device.

3. The device according to claim 1, wherein the conveying path has a length that is shorter than a length of the sheet.

4. An image forming system, comprising:

a sheet feeding unit;

a printing unit; and a sheet conveying device for conveying a sheet from the sheet feeding unit to the printing unit, the sheet conveying device comprising:

a conveying path forming unit configured to form a conveying path of a sheet, and an orthogonal movement permitting device provided in the conveying path and configured to convey the sheet along a conveying direction and allowing the sheet to move in a conveying orthogonal direction orthogonal to the conveying direction;

wherein the orthogonal movement permitting device includes a shaft extending in the conveying orthogonal direction, and wherein the shaft includes only one rubber roller or only one paddle arranged at a center position of the shaft in the conveying orthogonal direction, the shaft includes the one paddle, and the one paddle includes a plurality of plate members arranged at intervals in a circumferential direction of the shaft.

5. The system according to claim 4, further comprising:

an aligning mechanism configured to adjust a position of a leading end of the sheet conveyed by the orthogonal movement permitting device.

6. The system according to claim 4, wherein the conveying path has a length that is shorter than a length of the sheet.

7. A sheet conveying method, comprising:

conveying, by an orthogonal movement permitting device, a sheet along a conveying direction of a conveying path; and moving, by the orthogonal movement permitting device, the sheet in a conveying orthogonal direction orthogonal to the conveying direction while moving the sheet along the conveying direction;

wherein the orthogonal movement permitting device includes a shaft extending in the conveying orthogonal direction, and wherein the shaft includes only one rubber roller or only one paddle arranged at a center position of the shaft in the conveying orthogonal direction, the shaft includes the one rubber roller, the one rubber roller has an anisotropic friction generation direction and a contact surface that abuts the sheet, and the contact surface has a first friction coefficient in the conveying direction and a second friction coefficient in the conveying orthogonal direction, wherein the second friction coefficient is smaller than the first friction coefficient.

8. The method according to claim 7, further comprising:

adjusting a position of a leading end of the sheet in the conveying orthogonal direction.

* * * * *